US008186719B2

(12) United States Patent
Kume

(10) Patent No.: US 8,186,719 B2
(45) Date of Patent: May 29, 2012

(54) PIPE CONNECTING STRUCTURE OF HEAT EXCHANGER

(75) Inventor: Takayuki Kume, Tochigi (JP)

(73) Assignee: Calsonic Kansei Corporation, Saitama-shi (JP)

( * ) Notice: Subject to any disclaimer, the term of this patent is extended or adjusted under 35 U.S.C. 154(b) by 248 days.

(21) Appl. No.: 12/300,878

(22) PCT Filed: May 11, 2007

(86) PCT No.: PCT/JP2007/059762

§ 371 (c)(1),
(2), (4) Date: Nov. 14, 2008

(87) PCT Pub. No.: WO2007/132779

PCT Pub. Date: Nov. 22, 2007

(65) Prior Publication Data

US 2009/0205814 A1 Aug. 20, 2009

(30) Foreign Application Priority Data

May 17, 2006 (JP) ..... 2006-137910
Apr. 23, 2007 (JP) ..... 2007-113473

(51) Int. Cl.
*F16L 39/00* (2006.01)
*F28D 7/06* (2006.01)

(52) U.S. Cl. ..... 285/124.3; 165/176

(58) Field of Classification Search ..... 285/124.1, 285/124.2, 124.3, 124.4, 124.5; 29/890.052, 29/890.054; 165/153, 175, 176
See application file for complete search history.

(56) References Cited

U.S. PATENT DOCUMENTS

| | | | | | |
|---|---|---|---|---|---|
| 4,875,716 | A * | 10/1989 | Winzen et al. | 285/124.4 |
| 5,354,101 | A * | 10/1994 | Anderson, Jr. | 285/25 |
| 5,477,919 | A * | 12/1995 | Karube | 165/176 |
| 5,630,326 | A * | 5/1997 | Nishishita et al. | 62/299 |
| 6,196,306 | B1 * | 3/2001 | Aikawa et al. | 165/178 |
| 6,776,225 | B2 * | 8/2004 | Leitch et al. | 165/178 |
| 7,174,953 | B2 * | 2/2007 | Chiba | 165/153 |
| 7,219,717 | B2 * | 5/2007 | Hanafusa | 165/153 |
| 7,673,670 | B2 * | 3/2010 | Higashiyama et al. | 165/79 |
| 2003/0080554 | A1 * | 5/2003 | Schroeder et al. | 285/125.1 |
| 2004/0201212 | A1 * | 10/2004 | Marks | 285/124.1 |
| 2007/0215331 | A1 | 9/2007 | Higashiyama et al. | |
| 2008/0048437 | A1 * | 2/2008 | Simmons et al. | 285/124.5 |

FOREIGN PATENT DOCUMENTS

| | | | |
|---|---|---|---|
| JP | 10-281685 | A | 10/1998 |
| JP | 2003-294389 | A | 10/2003 |
| JP | 2005-291695 | A | 10/2005 |

* cited by examiner

*Primary Examiner* — James Hewitt
(74) *Attorney, Agent, or Firm* — Foley & Lardner LLP

(57) ABSTRACT

A pipe connector (60) configured to be attached to a tubular connecting port (63, 64) extending from a connector-mounting surface (54) of a heat exchanger body (1*a*) includes a plate-like or block-like shape base (65), an insert portion (61*a*, 62*a*) projecting from one side (65F) of the base (65) facing to the connector-mounting surface and configured to be fit in and connected to the connecting port (63, 64), and a leg portion (70) projecting from the one side (65F) and configured to be abut on the connector-mounting surface (54).

5 Claims, 10 Drawing Sheets

PIPE CONNECTING STRUCTURE OF HEAT EXCHANGER

TECHNICAL FIELD

The present invention relates to a pipe connector of a heat exchanger.

BACKGROUND ART

An air conditioner installed in a car is equipped with a heat exchanger, such as an evaporator, a condenser, or the like. The heat exchanger is provided with a heat exchange body and a pipe connector mounted to the heat exchange body. The pipe connector is used for connecting pipes, which are an inlet pipe that introduces heat medium to the heat exchange body and an outlet pipe that discharges heat medium from the heat exchange body, to the heat exchange body.

For example, Japanese Patent Laid-Open No. 2003-294389 discloses a pipe connector that is integrally formed with a base in a plate-like or block-like shape, a tubular inlet connecting portion for connecting an inlet pipe, and a tubular outlet connecting portion for connecting an outlet pipe. When the pipe connector is mounted to the heat exchange body, one end (insert portion) of the respective connecting portions of the pipe connector is inserted into and jointed (brazed) to respective connection ports formed in a connector-mounting surface of the heat exchange body.

DISCLOSURE OF THE INVENTION

FIG. 16 shows a conventional example of a mounting structure of a pipe connector of a heat exchanger. In FIG. 16, 101 indicates a connector-mounting surface of a heat exchange body, 100 indicates a tubular connecting port that extends outwardly from the connector-mounting surface 101. In this structure, a tubular insert portion 201 of a pipe connector 200 is inserted into and brazed to the connecting port 100 of the connector-mounting surface 101.

When the pipe connector 200 is fixed to the connecting port 100, the insert portion 201 of the pipe connector 200 is supported by an inner circumferential surface 101*a* of the connecting port 100 of the connector-mounting surface 101. It is noted that a base 202 of the pipe connector 200 can contact to a tip 100*b* of the connecting port 100 of the connector-mounting surface 101. For example, during a transportation of the heat exchanger or an operation for mounting pipes to the heat exchanger, a large force can be applied to the pipe connector 200. This can cause a deformation of the connecting port 100 so that the pipe connector 200 can be inclined with respect to the connector-mounting surface 101 of the heat exchange body. With an inclined pipe connector 200, an operation for connecting pipes to the connector can be difficult.

The present invention is made based on the above problem and provides a pipe connector of a heat exchanger capable of maintaining a stable attachment condition.

An aspect of the present invention is a pipe connector of a heat exchanger configured to be mounted to a tubular connecting port extending from a connector-mounting surface of a heat exchanger body, including a plate-like or block-like shape base, an insert portion projecting from one side of the base which faces to the connector-mounting surface and configured to be fit in and connected to the connecting port of the connector-mounting surface, and a leg portion projecting from the one side of the base and configured to be abut on the connector-mounting surface.

BRIEF DESCRIPTION OF THE DRAWINGS

FIG. 4(*a*) shows an unassembled state and FIG. 4(*b*) shows an assembled state.

DETAILED DESCRIPTION OF THE INVENTION

Embodiments of the present invention will be explained with reference to the drawings.

First Embodiment

A pipe connector of a heat exchanger according to a first embodiment of the present invention will be explained with reference to FIGS. 1 to 8.

The heat exchanger 1 of this embodiment is an evaporator that is used for a refrigeration cycle of a vehicular air conditioner. It should be appreciated that the present invention can be applied to other types of heat exchangers.

Figure 1:
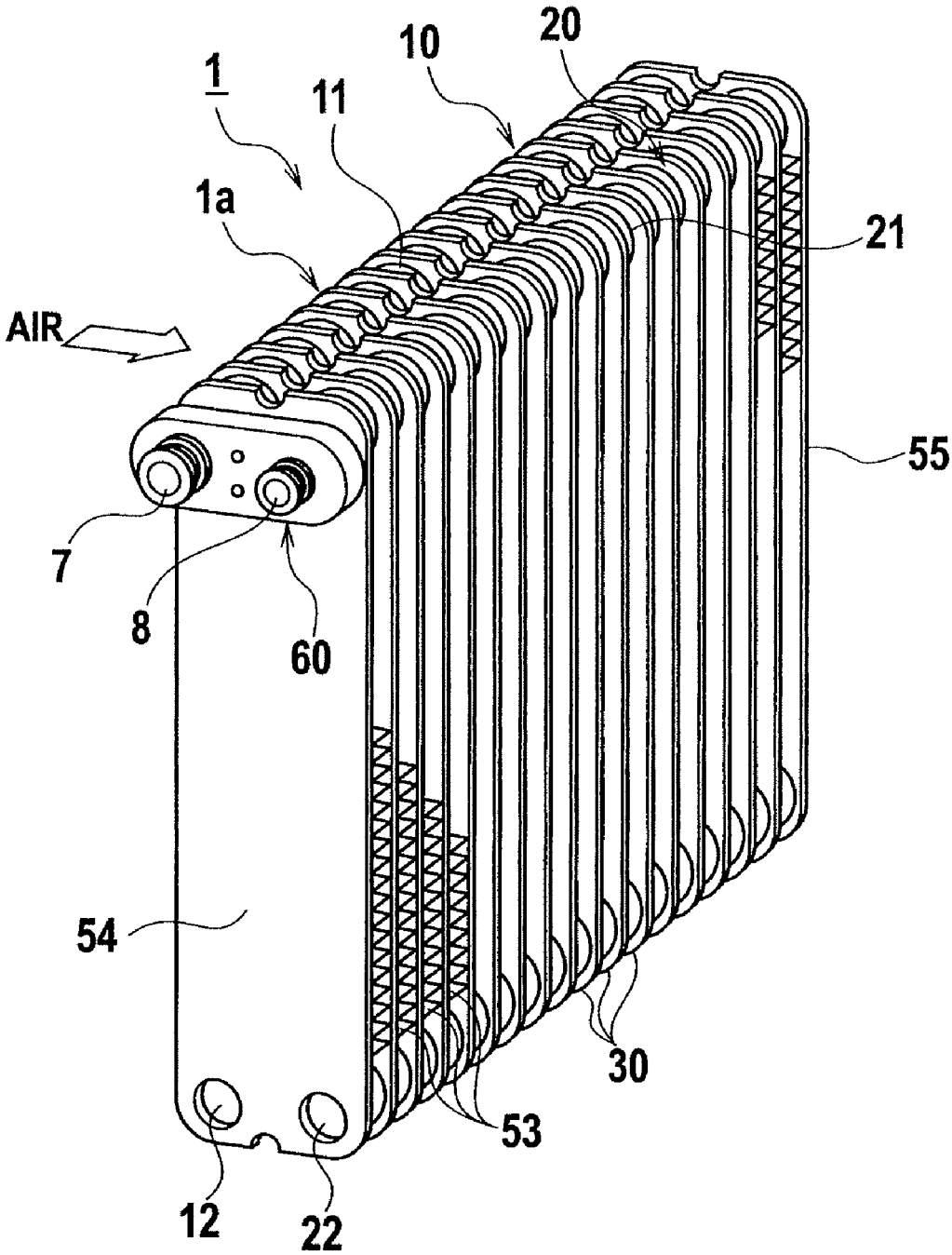
FIG. 1 is a perspective view of a heat exchanger having a pipe connector according to a first embodiment of the present invention.
Figure 2:
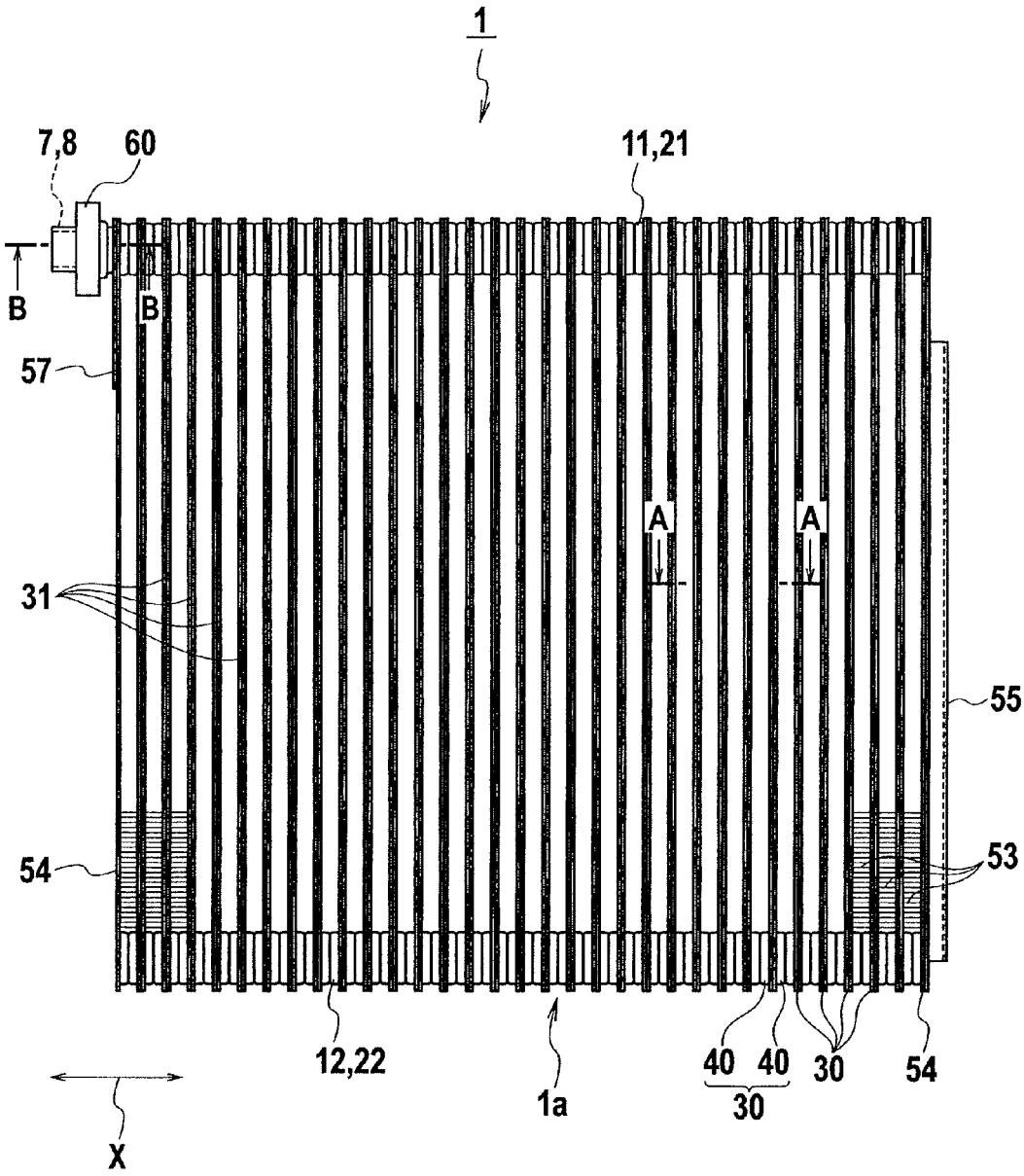
FIG. 2 is a front view of the heat exchanger having the pipe connecter of the first embodiment.

The heat exchanger 1, as shown in FIGS. 1 and 2, is provided with a heat exchange body 1*a* and a pipe connector 60 attached to the heat exchange body 1*a*. The pipe connector 60 constitutes a heat exchanger inlet port 7 and a heat exchanger outlet port 8 in a manner that an inlet pipe and an outlet pipe are connected to the pipe connector 60.

Figure 3:
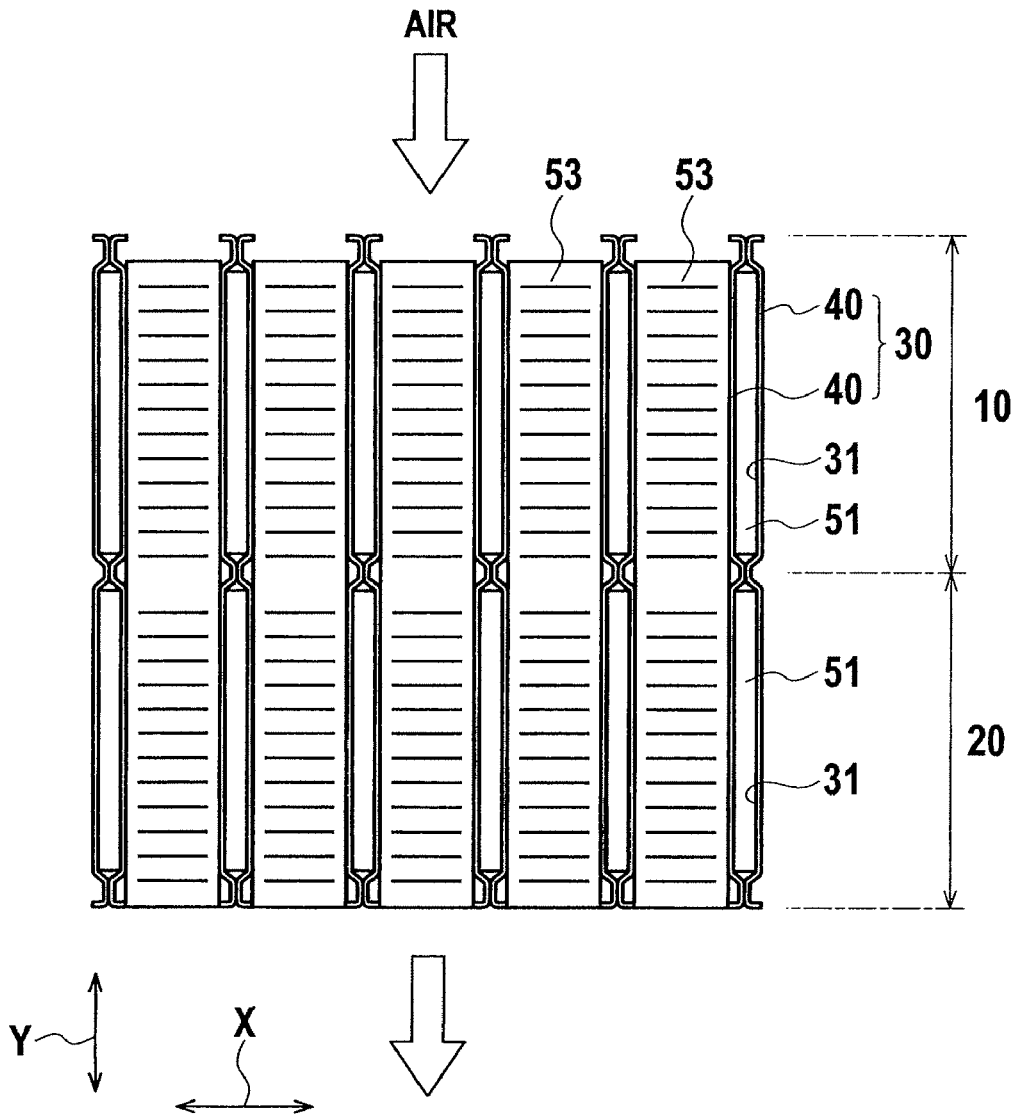
FIG. 3 is an enlarged cross sectional view taken along the line A-A in FIG. 2.
Figure 4:
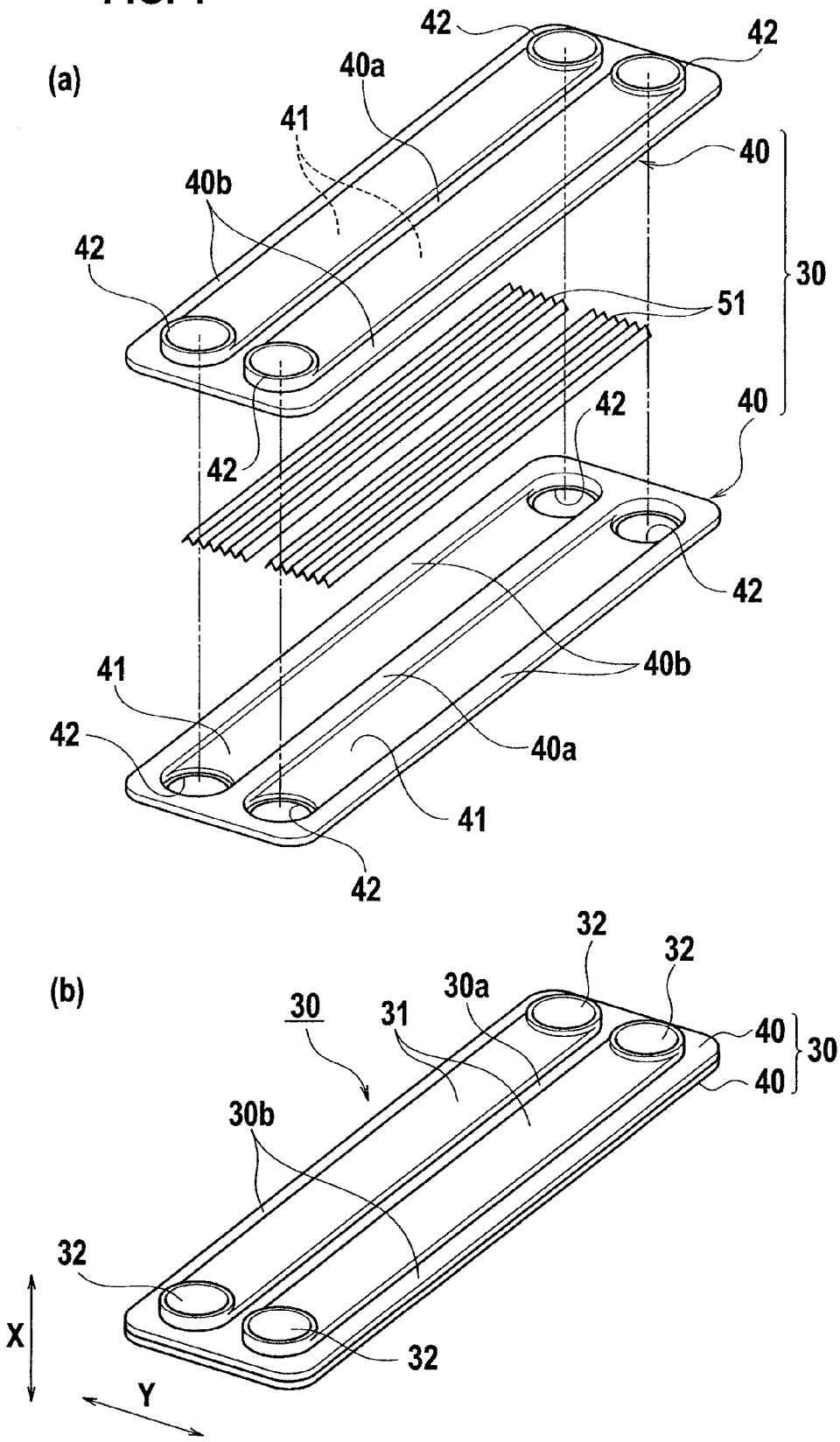
FIGS. 4(*a*) and 4(*b*) are perspective views of a tube of the heat exchanger of the first embodiment.

As shown in FIGS. 1 to 3, the heat exchange body 1*a* has a first heat exchange core 10 to which refrigerant is introduced and a second heat exchange core 20 from which refrigerant is discharged. The first and second heat exchange cores are arranged in a line in an air-flow direction Y. The first heat exchange core 10 is formed with an upper tank 11, a lower tank 12, and a plurality of heat exchange paths 31 that connect the upper tank 11 and the lower tank 12. The second heat exchange core 20 is also formed with an upper tank 21, a lower tank 22, and a plurality of heat exchange paths 31 that connect the upper tank 21 and the lower tank 22.

The heat exchanger 1 is formed as follows. Vertically placed tubes 30 and outer fins 53 are stacked alternatively in a horizontal direction X and metal side plates 54, reinforcement plates 55, 57, the pipe connector 60 and other members are attached to the stacked ends, so that a given shaped assembly of heat exchanger is formed. The given shaped assembly is heated and cooled to braze the members of the assembly with each other by using brazing layers applied on surfaces of the members, so as to form the heat exchanger.

The tube 30 used for the heat exchanger consists of a pair of metal plates 40 that are attached to each other as sandwiching inner fins 51 therebetween. The metal plate 40 is formed with two elongate recesses 41 that are separated from each other by a center partition 40*a* and extend in a longitudinal direction of the metal plate 40, and tubular tank portions 42 that extend from both longitudinal ends of the recesses 41 in a thickness direction of the metal plate 40 so as to open both longitudinal ends of the recesses 41. The tube 30 is formed by combining the pair of metal plates 40 such that the metal plates 40 are joined to each other except for the portions of the recesses 41. In other words, peripheral joining areas 40*b* of the metal plates 40 are joined to each other and the center partitions 40*a* of the metal plates 40 are joined to each other. With this configuration, in the tube 30, two heat exchange paths 31 for flowing refrigerant therethrough are defined on each side of the center partition 40*a*, and tank portions 32, 32 protruding outwardly in the stacking direction X are formed at both ends of the two heat exchange paths 31.

In such a manner that the tubes 30 are stacked, the adjacent tubes are connected to and communicated with each other at the tank portions 32, and the communicating areas extending in the stacking direction form the tanks 11, 12, 21 and 22 of the heat exchanger.

At one longitudinal ends of the upper tanks 11, 21, the pipe connector 60 is provided and the pipe connector 60 constitutes the inlet port 7 and the outlet port 8 of the heat exchanger 1.

The refrigerant introduced into the inlet port 9*b* passes through the first heat exchanger core 10, a communication path (not shown) and the second heat exchanger core 20, and is discharged from the upper tank 21 of the second heat exchanger core 20 via the heat exchanger outlet port 8.

Next, the pipe connector 60 and the mounting structure of the pipe connector 60 will be described in detail.

Figure 5:
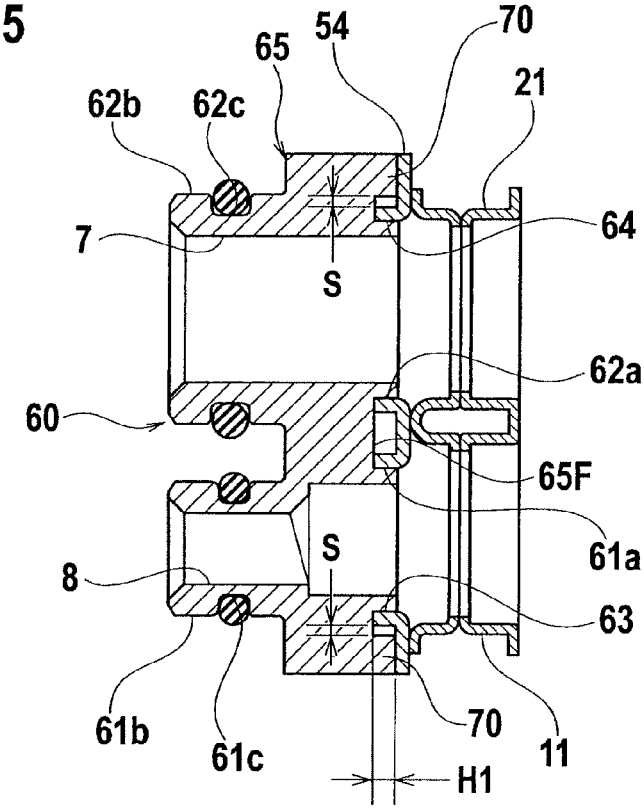
FIG. 5 is an enlarged cross sectional view taken along the line B-B in FIG. 2.
Figure 6:
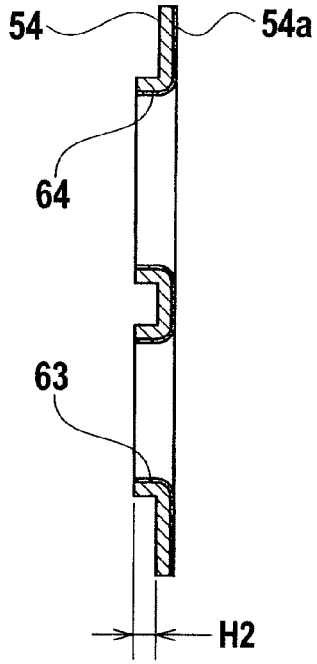
FIG. 6 is an enlarged cross sectional view of a portion where connecting ports of the connector-mounting surface is formed according to the first embodiment.

The side plate 54 of the heat exchange body 1*a* serves as a connector-mounting surface on which the pipe connector 60 is mounted. As shown FIG. 5, the side plate 54 serving as the connector-mounting surface is formed with a first connecting port 63 which communicates with the upper tank 11 of the first heat exchanger core 10 and a second connecting port 64 which communicates with the upper tank 21 of the second heat exchanger core 20. The first and second connecting ports 63, 64 are formed in a tubular shape which extends outwardly from the side plate 54 of the heat exchanger body 1*a* as shown in FIGS. 5 and 6.

The pipe connector 60 is connected to these connecting ports 63, 64. Namely, as shown in FIG. 5, in a manner that the insert portion 61*a* is inserted in the first connecting port 63 and the insert portion 62*a* is inserted in the second connecting port 64 (that is, in a manner that the pipe connector 60 is pre-mounted to the heat exchange body 1*a*), the pipe connector 60 is heated and cooled together with the heat exchange body 1*a* so that the brazing layer 54*a* previously applied on the inner face of the side plate 54 is dissolved and coagulated to fix (braze) the pipe connector 60 to the heat exchange body 1*a*.

The configuration of the pipe connector 60 will be described in detail. As shown in FIG. 5, the pipe connector 60 includes a plate-like or box-like shaped base 65, first and second tubular insert portions 61*a*, 62*a* which are extended from one side of the base 65, and first and second tubular pipe connection portions 61*b*, 62*b* which are extended from the other side of the base 65. A first through path 7 passing through the base 65 is formed to communicate the inside of the first insert portion 61*a* with the inside of the first pipe connection portion 61*b*. The through path 7 serves as the inlet 7 of the heat exchanger. Further, a second through path 8 passing though the base 65 is formed to communicate the inside of the second insert portion 62*a* with the inside of the second pipe connection portion 62*b*. The second through path 8 serves as the outlet 8 of the heat exchanger. The pipe connector 60 is manufactured by cutting a block that is forged into a substantial shape based on a shape to be manufactured.

Figure 7:
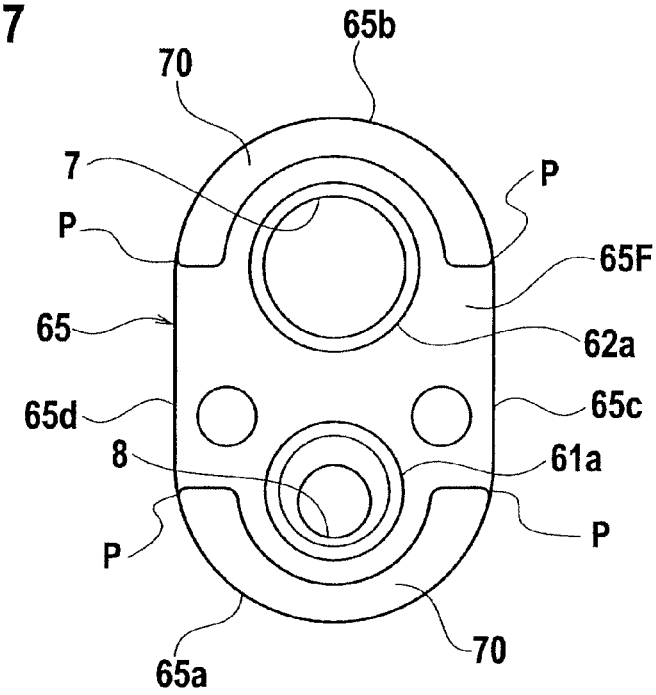
FIG. 7 is a rear view of the pipe connector according to the first embodiment of the present invention.
Figure 8:
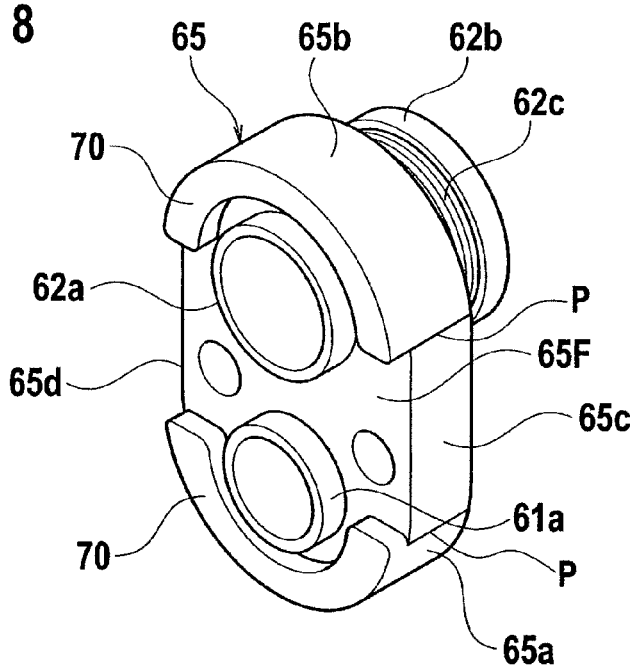
FIG. 8 is a rear perspective view of the pipe connector of the first embodiment.

As shown in FIGS. 7 and 8, the outer surface of the base 65 is formed in a elliptic shape having semi-arc-shaped faces 65*a*, 65*b* about the first and second insert portions 61*a*, 62*a* and straight faces 65*c*, 65*d* which connect the arc-shaped faces 65*a*, 65*b*.

The insert portions 61*a*, 62*a* are projected from one side of the base 65 which faces the side plate 54, and are to be inserted into the connecting ports 63, 64 of the side plate 54 and fixed to the heat exchange body 1*a*. On the other hand, the pipe connection portions 61*b*, 62*b* are projected from the other side of the base 65 which is opposite from the side plate 54, and are to be connected with a refrigerant introduction pipe and a refrigerant discharge pipe (not shown). On a middle portion of the outer circumferential surfaces of the pipe connection portions 61*b*, 62*b*, circumferential grooves 61*c*, 62*c* for mounting O-rings (not shown) are provide.

According to the present embodiment, leg portions 70 are projected from the one side 65F, which faces the side plate 54, toward the side plate 54 so as to contact with the side plate 54. With this configuration, the pipe connector 60 is securely mounted to the heat exchange body 1*a*.

The leg portions 70 are provided both ends of the base 65 as shown in FIGS. 7 and 8, and respectively formed in a semi-arc shape along the arc-shaped faces 65*a*, 65*b*.

Further, as shown in FIGS. 5 and 6, the height H1 of the leg portions 70 is greater than the height H2 of the connecting ports 63, 64 (H1>H2). With this configuration, the leg portions 70 are surely abut on the side plate 54 while the insert portions 61*a*, 62*a* are inserted to the connecting ports 63, 64.

As shown in FIG. 5, the leg portions 70 are placed apart from the outer circumferential surfaces of the connecting ports 63, 64 with a space S, not to be contacted with the outer circumferential surfaces of the connecting ports 63, 64.

The pipe connector 60 of the present embodiment having the above configuration is mounted and fixed to the heat exchange body 1*a* as described below.

The insert portions 61*a*, 62*a* are inserted into the first and second connecting ports 63, 64 to pre-mount the pipe connector 60 to the side plate 54. Here, the leg portions 70 extended from the base 65 are abut on the side plate 54. When the pipe connector 60 and the heat exchange body 1*a* are heated and then cooled in this condition, the outer circumferential surfaces of the insert portions 61*a*, 62*a* are brazed to the inner circumferential surfaces of the first and second connecting ports 63, 64 so that the pipe connector 60 is joined and fixed to the heat exchange body 1*a*.

With this fixing state of the pipe connector 60, since the leg portions 70 of the pipe connector 60 are abut on the side plate 54, the pipe connector 60 is more securely fixed compared to conventional structures which do not have leg portions 70, and, even when a large load is applied to the pipe connector 60, the pipe connector 60 is hardly tilted with respect to the heat exchange body 1*a*. That is, the pipe connector 60 is hardly displaced, even when a force is applied to the pipe connector 60 during a transportation of the heat exchanger 1 or an operation for connecting or disconnecting pipes to or from the heat exchanger 1. As a result, this prevents a difficulty in a pipe connecting operation and increases the product value of the heat exchanger 1.

Effects of the present embodiment will be described.

Firstly, the pipe connector 60 of the present embodiment is a pipe connector 60 configured to be attached to tubular connecting ports 63, 64 extending from a connector-mounting surface 54 of a heat exchanger body 1*a*. The pipe connector 60 includes a plate-like or block-like shape base 65, an insert portions 61*a*, 62*a* projecting from the one side 65F of the base 65 which faces to the connector-mounting surface 54 and configured to be fit in and connected to the connecting ports 63, 64, and a leg portions 70 projecting from the one side 65F and configured to be abut on the connector-mounting surface 54.

In this configuration, when the pipe connector 60 is fixed, the insert portions 61*a*, 62*a* of the pipe connector 60 is fixed and the leg portions 70 of the pipe connector 60 are abut on the side plate 54. The pipe connector 60 is thus more securely fixed compared to conventional structures that do not include the leg portions 70. The pipe connector 60 is, therefore, hardly tilted with respect to the heat exchange body even when a large load is applied to the pipe connector 60. This increases the product value of the heat exchanger 1.

Secondly, according to the present embodiment, the leg portions 70 are provided apart from outer circumferential surfaces 63, 64. In this configuration, the brazing layer melted between the outer circumferential surfaces of the insert portions 61*a*, 62*a* and the inner circumferential surfaces of the connecting ports 63, 64 can be prevented from leaking to other parts via the leg portions 70 due to a capillary action. The joint between the welded pipe connector 60 and the side plate 54 thus can be maintained in a proper condition.

In other words, when it is assumed that the leg portions 70 contact with the outer circumferential surface of the connecting ports 63, 64, the melted brazing layers between the outer circumferential surfaces of the insert portions 61*a*, 62*a* and the inner circumferential surfaces of the connecting ports 63, 64 can be leaked out via the joint between the outer circumferential surfaces of the connecting ports 63, 64 and the leg portions 70; however, this problem can be prevented according to the present embodiment.

The first embodiment describes that two leg portions 70 having a semi-arc shape along the arc-shaped faces 65*a*, 65*b* are provided at both ends of the base 65; however, the leg portions 70 can be made in any shape that securely supports the pipe connector 60 attached to the side plate 54. For example, leg portions 70A of a second embodiment shown in FIGS. 9 and 10 or leg portions 70B of a third embodiment shown in FIGS. 11 and 12 can be used.

Second Embodiment

Figure 9:
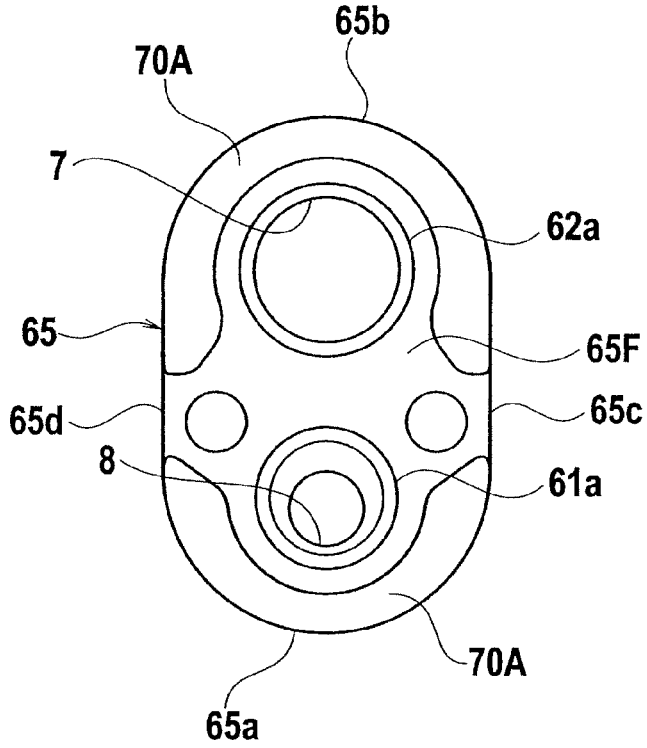
FIG. 9 is a rear view of a pipe connector of a second embodiment of the present invention.
Figure 10:
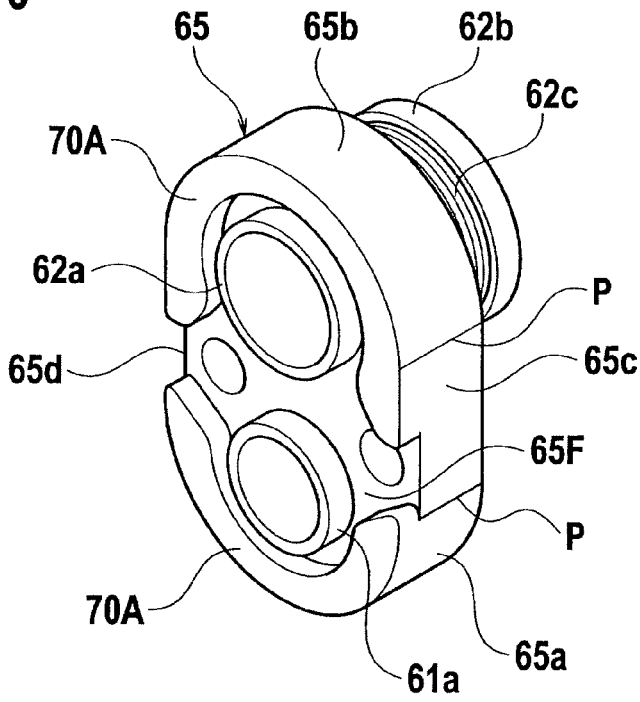
FIG. 10 is a rear perspective view of the pipe connector of the second embodiment.

FIG. 9 is a rear view of a pipe connector of the second embodiment and FIG. 10 is a rear perspective view of the pipe connector. In this second embodiment, leg portions 70A formed in a U-shape along the arc-shaped faces 65*a*, 65*b* are provided at both ends of the base 65. Especially, both tips of the leg portion 70A shown in an upper side in the figures extend along the both side faces 65*c*, 65*d* of the base 65 to a substantially central portion in a longitudinal direction (that is, the vertical direction in the figures) of the base 65.

Third Embodiment

Figure 11:
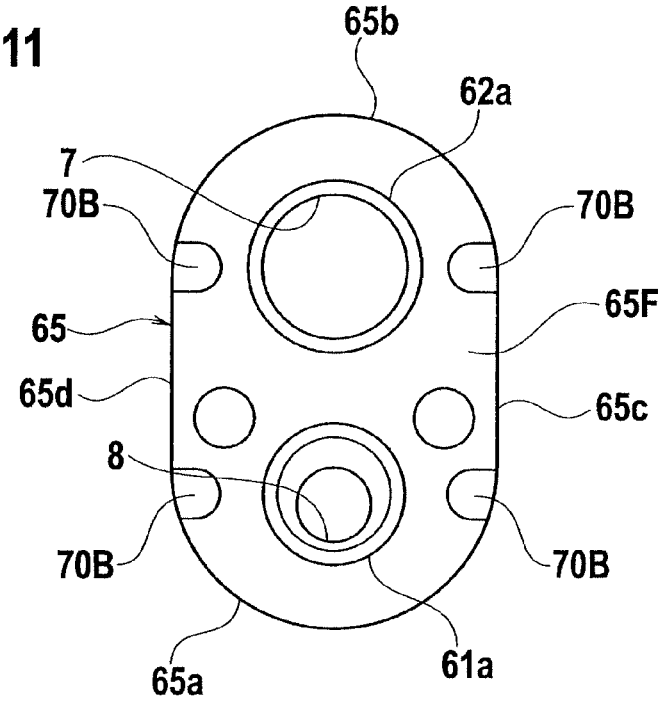
FIG. 11 is a rear view of a pipe connector of a third embodiment.
Figure 12:
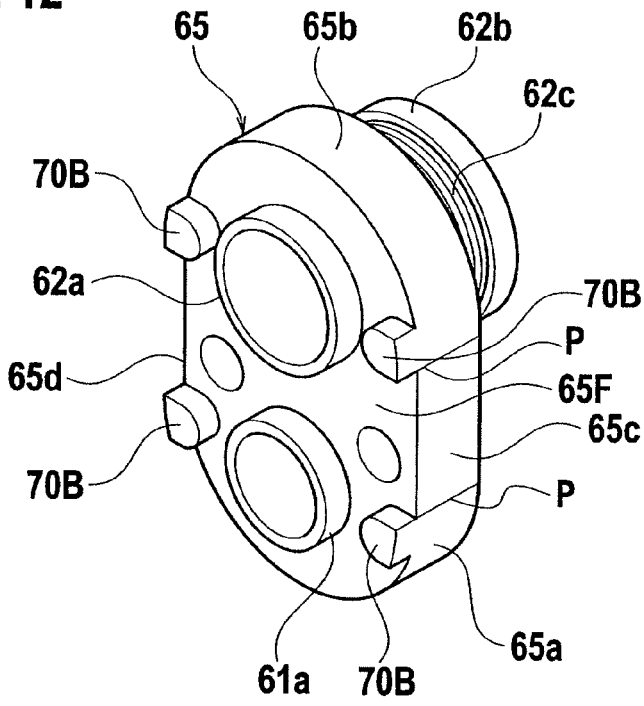
FIG. 12 is a rear perspective view of the pipe connector of the third embodiment.

FIG. 11 is a rear view of a pipe connector of the third embodiment and FIG. 12 is a rear perspective view of the pipe connector. In the third embodiment, four leg portions 70B are provided so as to surround the two insert portions 61*a*, 62*a* and all of the leg portions 70B are formed in a columnar shape projecting in a thickness direction of the base 65. The arrangement of the leg portions 70B respectively correspond to four inflection points which are boundaries of the arc-shaped faces 65*a*, 65*b* and the straight faces 65*c*, 65*d* of the base 65.

It should be appreciated that the same effects and operations as the first embodiment can be obtained according the second and third embodiments. In addition, spaces S are preferably provided between the leg portions 70A, 70B and the first and second connecting ports 63, 64 in the second and third embodiments.

Fourth Embodiment

Figure 13:
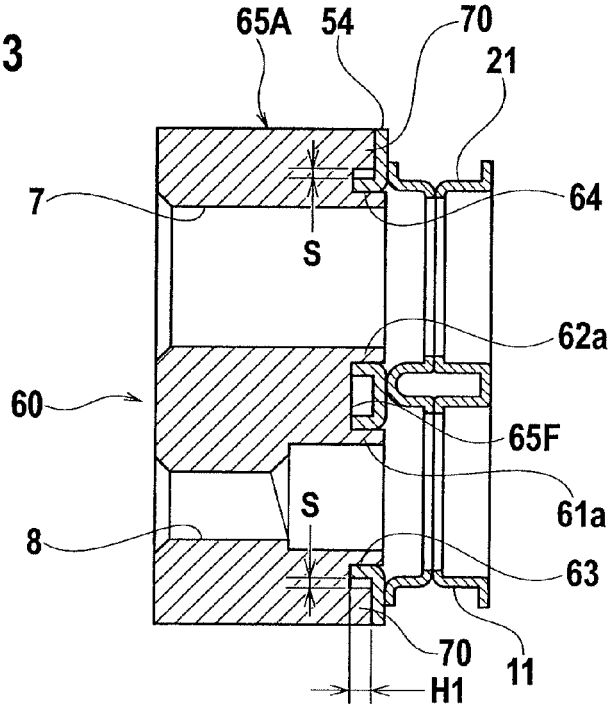
FIG. 13 is a cross sectional view of a mounted pipe connector of a fourth embodiment.
Figure 14:
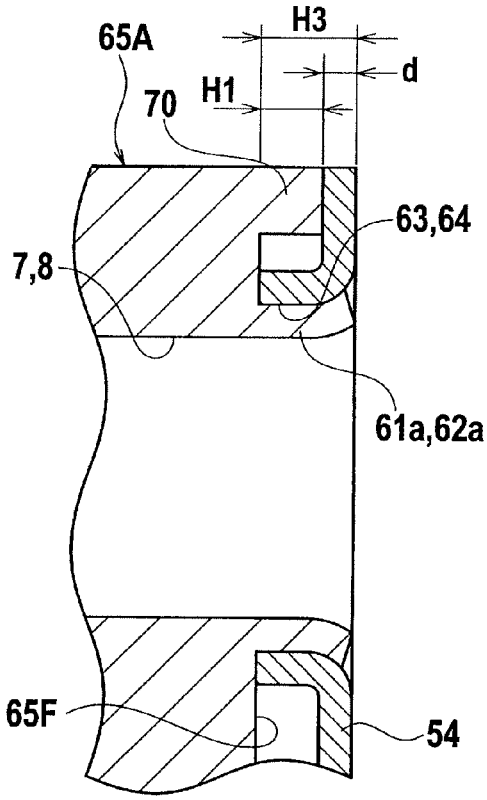
FIG. 14 is an enlarged cross sectional view of a periphery of an insert portion of the mounted pipe connector of the fourth embodiment.
Figure 15:
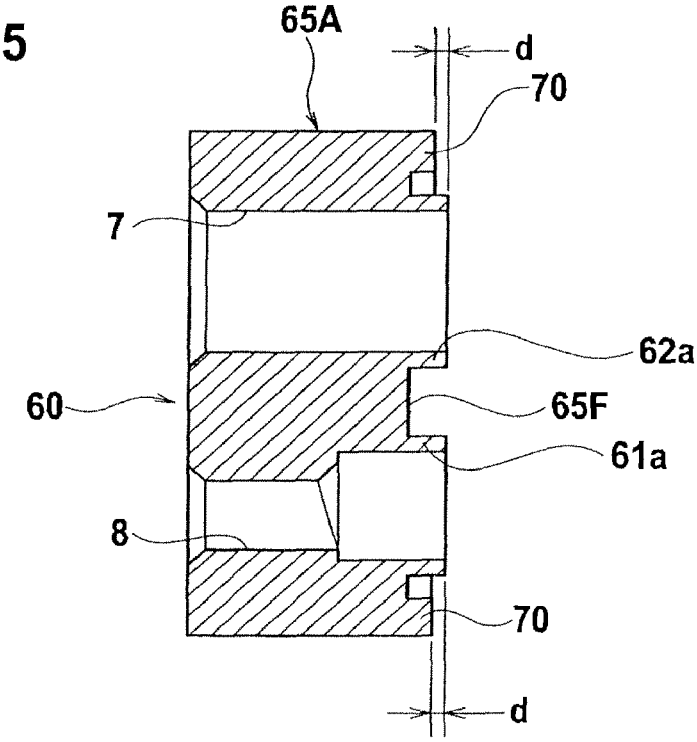
FIG. 15 is a cross sectional view of the pipe connector according to the fourth embodiment of the present invention.
Figure 16:
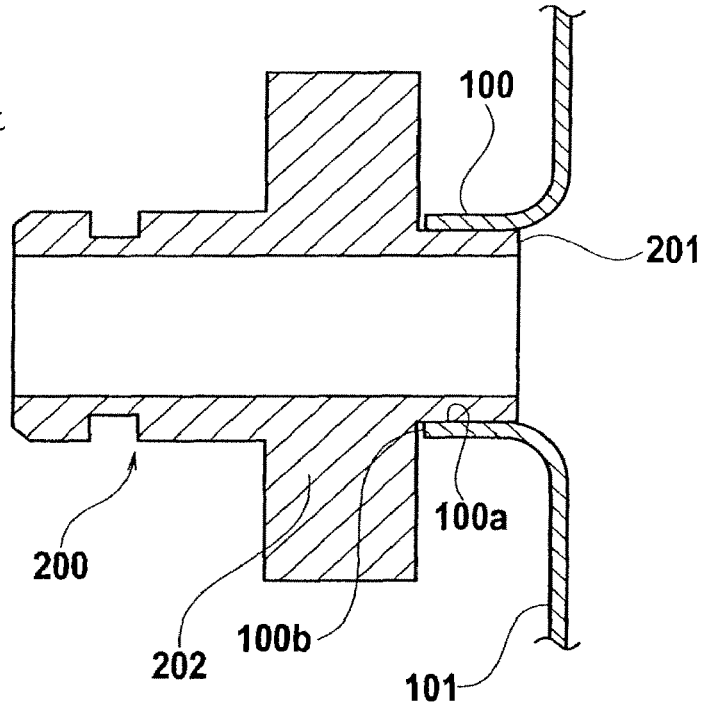
FIG. 16 Prior Art
FIG. 16 is a partially-enlarged view of a mounted conventional pipe connector.

A third embodiment of the present invention will be described. FIG. 13 is a sectional view showing a pipe connector of the fourth embodiment attached to the heat exchange body; FIG. 14 is an enlarged sectional view showing an area of the insert portions of the pipe connector of the fourth embodiment which is mounted to the heat exchange body; and FIG. 15 is a sectional view of the pipe connector of the fourth embodiment.

According to the pipe connector 60 of the first embodiment, the tips of the leg portions 70 and the tips of the insert portions 61*a*, 62*a* are formed in a same level; however, according to the pipe connector 60A of the fourth embodiment, the tips of the insert portions 61*a*, 62*a* are projected higher than the tips of the leg portions 70 substantially by a thickness d of the side plate 54. In other words, a projecting amount H3 (=H1+d) of the insert portions 61*a*, 62*a* from the one side 65F of the base 65 is greater than a projecting amount H1 of the leg portions 70 from one side 65F of the base 65. With such a configuration, while the pipe connector 60A is pre-mounted to the connector-mounting surface 54 of the heat exchange body 1*a*, the tips of the insert portions 61*a*, 62*a* of the pipe connector 60A is radially expanded so that the pipe connector 60A can be caulked to the connecting ports 63, 64 of the connector-mounting surface 54 to be pre-fixed, as shown in FIGS. 13 and 14.

With this configuration, when the pipe connector 60A is brazed to the heat exchange body 1*a*, the pipe connector 60A can be attached to the heat exchange body 1*a* in a secured condition.

Further, the pipe connector 60A of the fourth embodiment does not include a pipe connection portion (61*b*, 62*b*) projected from the base 65 and the pipes (not shown) are directly inserted to the through path 7, 8 of the pipe connector 60A.

According to the pipe connector 60A of the fourth embodiment, the same effects and operations as the first embodiment can be obtained.

Further, according to the pipe connector 60A of the fourth embodiment, since the insert portions 61*a*, 62*a* are projected higher than the leg portions 70, the insert portions 61*a*, 62*a* can be swaged while being inserted into the connecting ports 63, 64. With this configuration, when the pipe connector 60A is brazed to the heat exchange body 1*a*, the pipe connector 60A can be attached to the heat exchange body 1*a* in a secured condition.

The present invention is not limited to the above embodiments. Modifications and variations of the embodiments can be made without departing from the spirit or scope of the present invention. For example, the above embodiments has two insert portions of the pipe connector; however, a pipe connector having one, three or more insert portions can be used in the present invention.

The invention claimed is:

1. A pipe connecting structure of a heat exchanger, the pipe connecting structure comprising:

a heat exchanger body including a connector-mounting plate and a tubular connecting port extending outwardly from a surface of the connector-mounting plate;

a pipe connector configured to be attached to the connecting port;

wherein the connecting port extends toward the pipe connector, wherein the pipe connector includes:

a plate-shaped or block-shaped base;

an insert portion integrally projecting from one side of the base which faces toward the connector-mounting plate and configured to fit in and connect to the connecting port; and a leg portion integrally projecting from the one side of the base and contacting the surface of the connector-mounting plate, wherein an inner circumferential surface of the connecting port is fixed with an outer circumferential surface of the insert portion, and wherein a projection height of the leg portion from the one side of the base is greater than an extension height of the connecting port from the surface of the connector-mounting plate.

2. The pipe connecting structure according to claim 1, wherein the leg portion is spaced apart from an outer circumferential surface of the connecting port.

3. The pipe connecting structure according to claim 1, wherein the connecting port includes a brazing layer applied on the inner circumferential surface; and the inner circumferential surface of the connecting port is brazed with the outer circumferential surface of the insertion portion.

4. The pipe connecting structure according to claim 1, wherein the connecting port is disposed between the leg portion and the insert portion.

5. The pipe connecting structure according to claim 1, wherein the insert portion monolithic to the base.

* * * * *